US005492400A

United States Patent [19]

Röck

[11] Patent Number: 5,492,400

[45] Date of Patent: Feb. 20, 1996

[54] PULL-OUT GUIDE ASSEMBLY FOR DRAWERS AND THE LIKE

[75] Inventor: Erich Röck, Höchst, Austria

[73] Assignee: Julius Blum Gesellschaft m.b.H., Höchst, Austria

[21] Appl. No.: 261,325

[22] Filed: Jun. 16, 1994

[30] Foreign Application Priority Data

Jun. 29, 1993 [AT] Austria ..... 1269/93

[51] Int. Cl.[6] ..... A47B 88/08

[52] U.S. Cl. ..... 312/331; 312/334.6; 312/334.12

[58] Field of Search ..... 312/334.6, 334.8, 312/334.12, 334.13, 334.32, 334.9, 334.15, 334.33, 331, 334.1; 384/19, 18, 22

[56] References Cited

U.S. PATENT DOCUMENTS

| | | | |
|---|---|---|---|
| 1,851,183 | 3/1932 | Hill | 312/334.12 X |
| 1,902,795 | 3/1933 | Wolters | 312/334.13 X |
| 2,267,043 | 12/1941 | Premo | 384/18 |
| 3,078,129 | 2/1963 | Beeck | 384/19 |
| 3,124,401 | 3/1964 | McClellan | 312/334.13 |
| 3,545,833 | 12/1970 | Stein et al. | 321/334.9 |
| 3,687,505 | 8/1972 | Fall et al. | 384/18 |
| 3,722,964 | 3/1973 | Chitester et al. | 384/18 |
| 4,025,138 | 5/1977 | Kittle . | |
| 4,294,499 | 10/1981 | Röck et al. | 312/334.13 X |
| 4,351,575 | 9/1982 | Röck et al. | 312/334.12 X |
| 5,275,064 | 1/1994 | Hobbs | 384/18 X |
| 5,421,648 | 6/1995 | Grabher | 312/334.13 X |

FOREIGN PATENT DOCUMENTS

| | | |
|---|---|---|
| 2608905 | 7/1988 | France . |
| 2354130 | 4/1975 | Germany . |
| 4019124 | 12/1991 | Germany . |

*Primary Examiner*—Peter M. Cuomo
*Assistant Examiner*—Janet M. Wilkens
*Attorney, Agent, or Firm*—Wenderoth, Lind & Ponack

[57] ABSTRACT

A pull-out guide assembly for a drawer or the like includes a support rail to be fastened to a furniture side wall, a pull-out rail to be fastened to the drawer and an intermediate rail. Rollers transfer the load of the drawer from one rail to another. A cable is fastened to the support rail and is connectable to the pull-out rail, such cable running on pulleys mounted at front and rear ends of the intermediate rail. A coupling device is provided for releasably coupling the cable to the pull-out rail. The coupling device includes an inner elongated coupling member fastened to the cable and an outer coupling member fastened to the pull-out rail and embracing the inner coupling member. Both coupling members are provided with at least one rack member or arrangement of teeth that engage each other when in coupling position.

13 Claims, 4 Drawing Sheets

PULL-OUT GUIDE ASSEMBLY FOR DRAWERS AND THE LIKE

BACKGROUND OF THE INVENTION

1. Field of the Invention

The present invention relates to a pull-out guide assembly for a drawer or the like and including a support rail adapted to be fastened to a furniture side wall, a pull-out rail adapted to be fastened to the drawer and an intermediate rail, one such assembly being provided on each of opposite sides of the drawer. Rollers transfer the load of the drawer from one rail to another. A cable is fastened to the support rail and is connectable to the pull-out rail the runs on two pulleys mounted at front and rear ends of the intermediate rail.

2. Description of the Prior Art

Different types of pull-out guide assemblies are known with which a drawer can be pulled from the body of an article of furniture, over the entire length of the drawer, while still being anchored to the support rails on the sides of the body. With so-called differential pull-out guides which comprise three rails on each side, i.e. a pull-out rail on the side of the drawer, a supporting rail on the side of the body, and an intermediate rail differentially running between the two other rails, means are provided that ensure that the three rails are always in the correct position with respect to each other. Such means can comprise a pinion mounted on the intermediate rail and engaging with racks provided on the supporting rail and the pull-out rail.

Good control of the movement of the intermediate rail can be obtained by a cable fastened to the pull-out rail and the supporting rail and being guided on pulleys mounted on opposite ends of the intermediate rail.

SUMMARY OF THE INVENTION

In is an object of the invention to provide a cable control for controlling the movement of the rails of a differential pull-out guide assembly, wherein the drawer together with the pull-out rails can easily be removed from the assemblies and also be easily inserted into the assemblies, the pull-out rails being easily coupled with the cables.

According to the present invention this object is achieved by a coupling device for releasably coupling the cable to the pull-out rail, such coupling device including an inner elongated coupling member fastened to the cable and an outer coupling member fastened to the pull-out rail and embracing the inner coupling member, each of the coupling members being provided with at least one toothed or rack profile, with rack profiles engaging each other when in a coupling position.

Because of the rack profiles, there is range of tolerance provided within which the inner coupling member and the outer coupling member can be coupled. Because of this, the drawer always can be positioned in such a way that when it is in its rearmost position its front plate will always abut the front sides of the furniture side walls.

BRIEF DESCRIPTION OF THE DRAWINGS

In the following an embodiment of the present invention will be described in greater detail, with reference to the accompanying drawings, wherein.

DETAILED DESCRIPTION OF THE INVENTION

Figure 1:
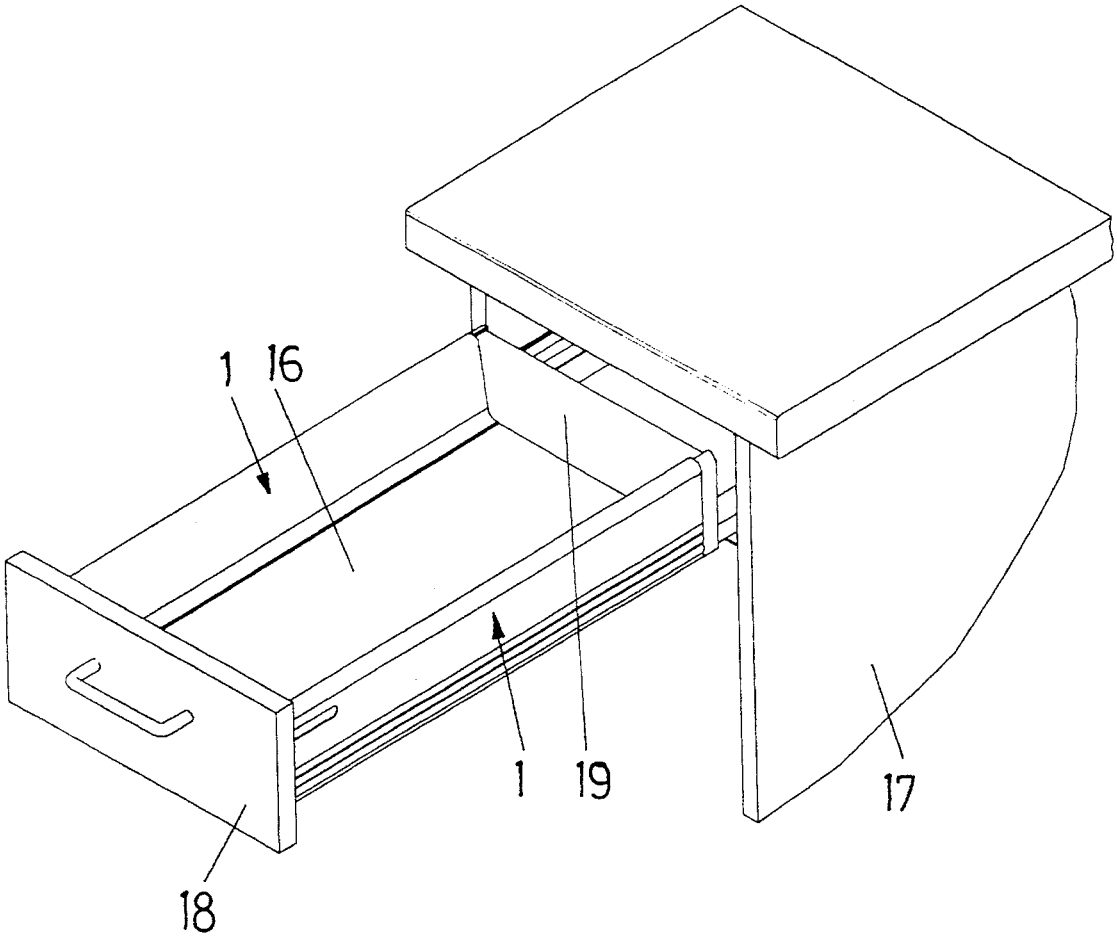
FIG. 1 is a perspective view of an article of furniture and a drawer, the drawer being shown in an outermost extended position.
Figure 2:
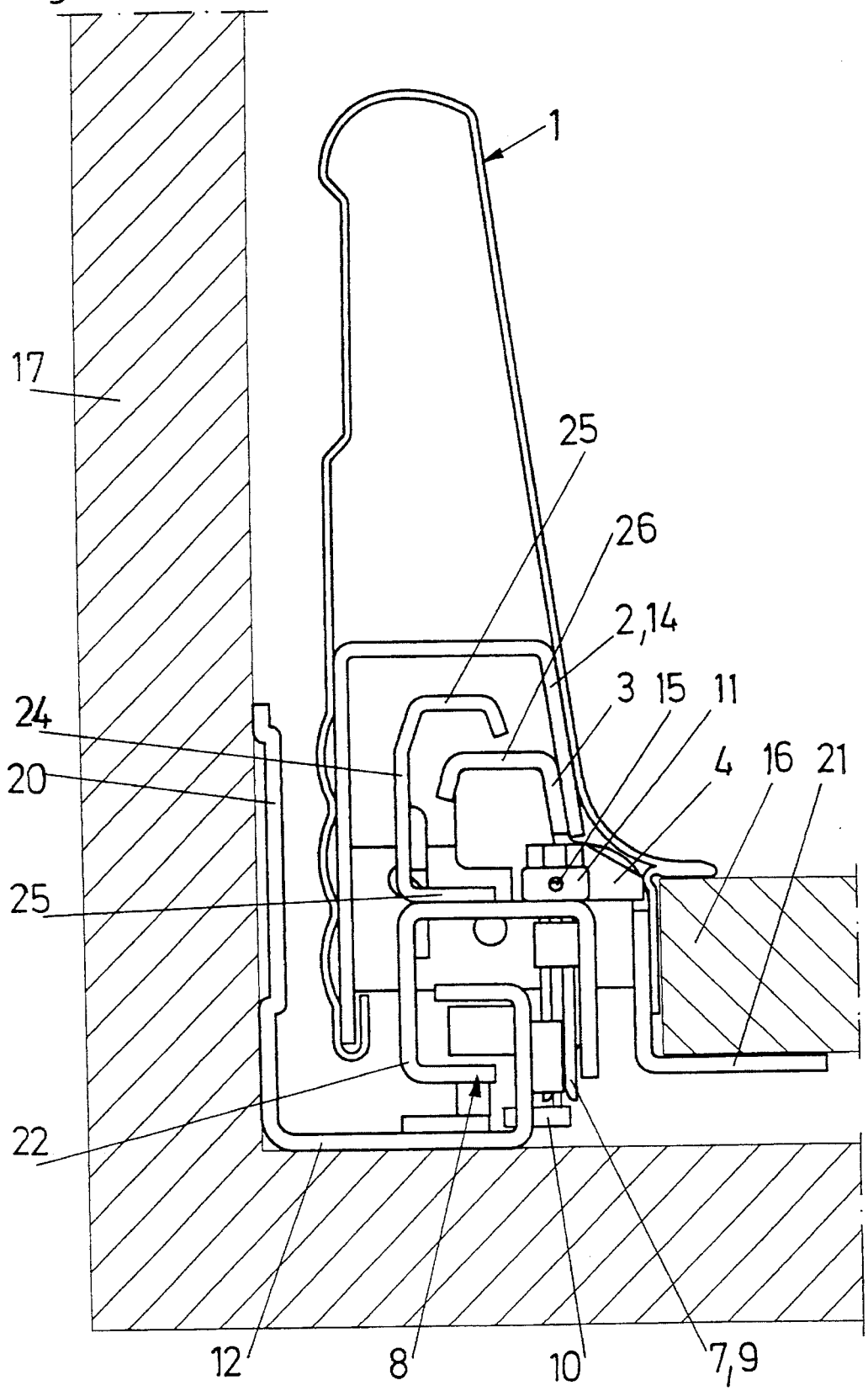
FIG. 2 is a sectional view of a side of the drawer.
Figure 3:
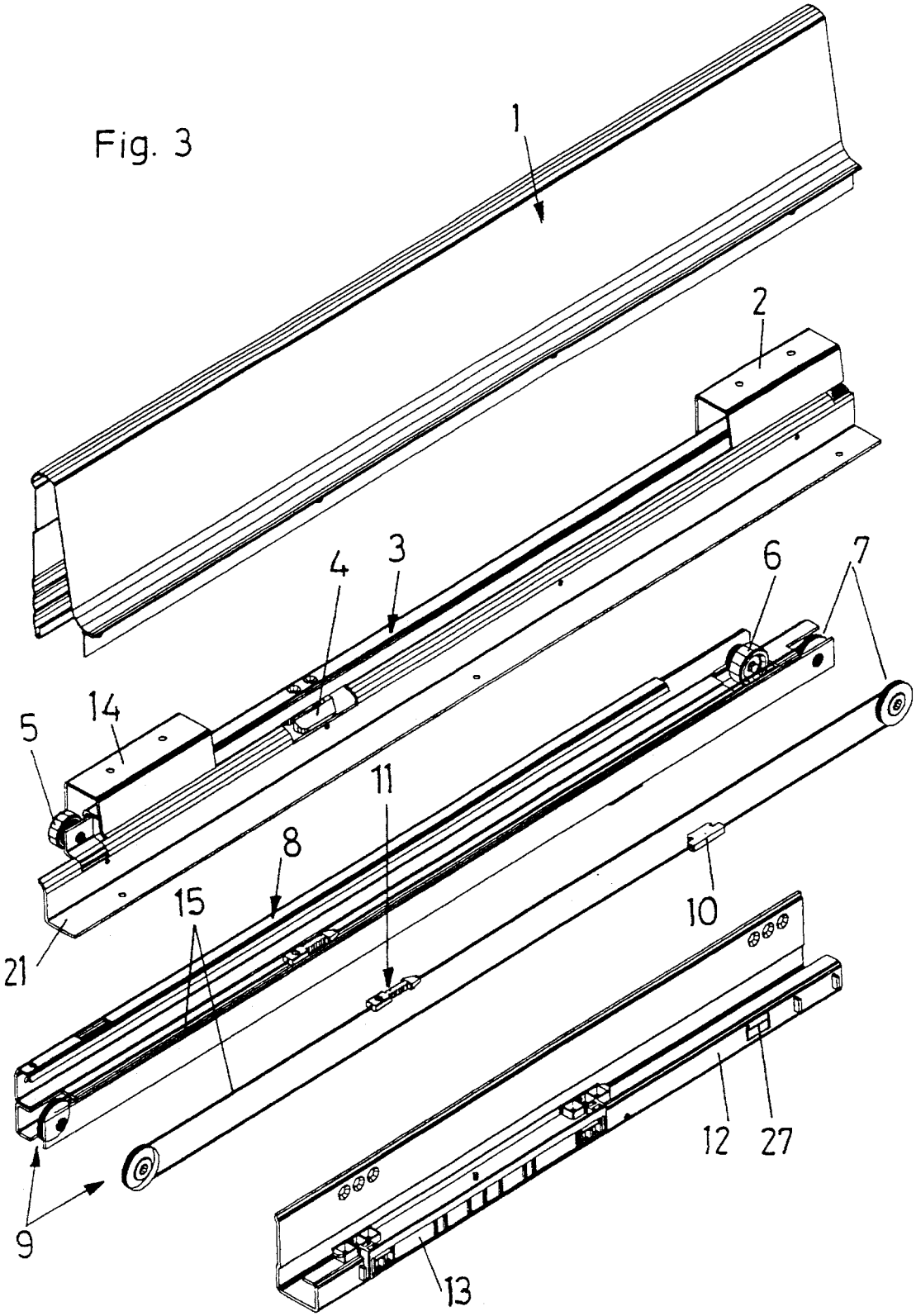
FIG. 3 is an exploded perspective view of the parts of a pull-out guide assembly and the drawer side wall.

A drawer includes two metallic side walls 1, a front plate 18, a bottom plate 16 and a rear wall 19. Within each side wall 1 are two adapters 2, 14 by means of which a pull-out rail 3 is fastened to the drawer side wall 1. A supported rail 12 is fastened to a respective side wall 17 of an article of furniture by means of a web 20 extending from the supporting rail 12. The bottom plate 16 of the drawer rests on a horizontal flange 21 of each pull-out rail 3.

An intermediate rail 8 is situated between each pull-out rail 3 and corresponding supporting rail 12. The intermediate rail 8 has a lower profile member 22 in which is situated a carriage 13 with rollers. Therefore, the intermediate rail 8 rests on the supporting rail 12 by means of the rollers of the carriage 13. The intermediate rail 8 also has an upper profile member 24 having at least approximately a C-shaped configuration. Between two horizontal flanges 25 of profile member 24 is guided a roller 5 that is mounted on the pull-out rail 3. A flange 26 of the pull-out rail 3 rests on a roller 6 mounted in the upper profile member 24 of the intermediate rail 8.

The intermediate rail 8 is provided with a front pulley 7 and a rear pulley 9 about which is mounted an endless cable 15. The cable 15, which may be a steel cable, is provided with a coupling member 10 that can be inserted into an opening 27 of the supporting rail 12 for snap-in coupling thereto, whereby the cable 15 is attached to the supporting rail 12.

Figure 4:
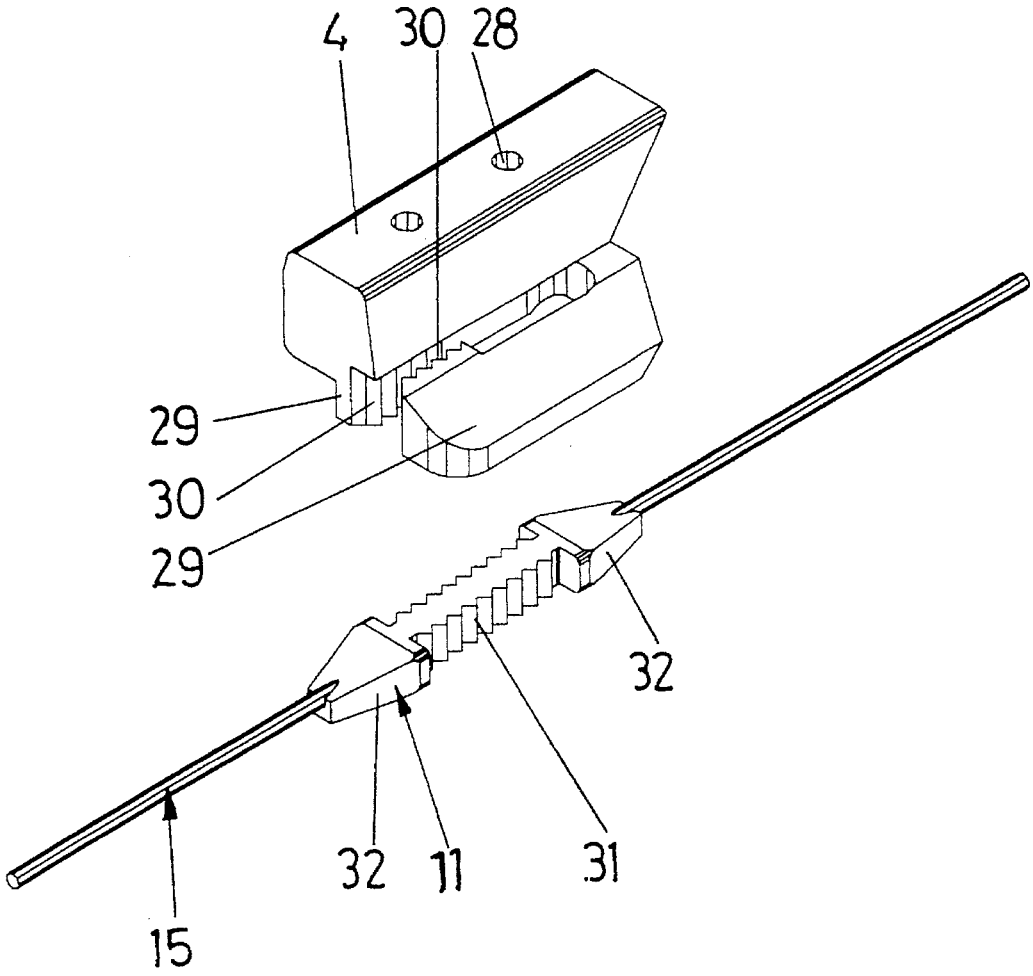
FIG. 4 shows an exploded perspective view of coupling members and a cable.

To connect the cable 15 with the pull-out rail 3, a coupling device according to the invention is provided. The coupling device includes an outer first coupling member 4 and an inner second coupling member 11. The outer coupling member 4 is fastened to the pull-out rail 3 by means of screws extending through holes 28 in coupling member 4. The coupling member 4 has a U-shaped configuration with two holding arms 29. On each holding arm 29 there is provided teeth or cogs in the form of a toothed rack 30. The inner coupling member 11 is rod shaped with the cable 15 extending through the length thereof, as can be seen in FIG. 4. The inner coupling member 11 is preferably injection molded to cable 15. On opposite sides of the inner coupling member 11 are provided teeth or cogs in the form of toothed racks 31, which correspond to the racks 30 of the holding arms 29 of the outer coupling member 4. The racks 30, 31 engage each other when the coupling members 4, 11 are coupled. The inner coupling member 11 has at opposite ends thereof respective tapered or conical heads 32 to facilitate coupling with the outer coupling member 4.

If the drawer is to be removed from the pull-out guide assembly, the coupling member 4 can be moved upwardly so that the racks 30 no longer engage with the racks 31. As the pull-out rail 3 is guided on the intermediate rail 8 by means of rollers 5, 6, which respectively are mounted on the pull-out rail 3 and the intermediate rail 8, the pull-out rail 3 can be easily removed. Removal, and even more so insertion, of the pull-out rail 3 would be more difficult if the rollers 5, 6 were mounted in separate carriages provided between the intermediate rail 8 and the supporting rail 12. To insert the drawer and for coupling the two coupling members 4, 11, the coupling member 4 can be pressed onto the coupling member 11 from above.

Because of the length of the racks 31 on the inner coupling member 11, the position of coupling of the coupling member 4 with the coupling member 11 with regard to the length of the drawer can be varied. That is, the coupling member 4 can engage the coupling member 11 over the whole length of the racks 30, thereby being positionable further in front or further in the rear whenever necessary.

It is, however, not necessary to engage the coupling member 4 with the coupling member 11 by moving the coupling member 4 downwardly. The drawer with the pull-out rail 3 can be pushed into intermediate rail 8 from the front and moved from the front to the rear. Because of conical ends 32 it is possible to push the coupling member 4 into engagement with the coupling member 11 from the front. In both cases, a fast simple coupling between the pull-out rails 3 and the cables 15 is obtained without the necessity of using a tool.

I claim:

1. A pull-out guide assembly for use on each of opposite sides of a drawer to guide movement of the drawer into and out of an article of furniture, said assembly comprising:

a supporting rail to be attached to a furniture side wall;

a pull-out rail to be attached to the drawer;

an intermediate rail between said supporting rail and said pull-out rail;

respective pulleys mounted on front and rear ends of said intermediate rail;

a cable running on said two pulleys and fastened to said supporting rail; and a coupling device to releasably connect said cable to said pull-out rail, said coupling device including a first coupling member fastened to said pull-out rail and having at least one toothed rack, and a second coupling member fastened to said cable and having at least one toothed rack, said first and second coupling members being selectively movable relative to each other between a coupled position, whereat said toothed rack of said first coupling member is in meshing engagement with said toothed rack of said second coupling member, and an uncoupled position, whereat said meshing engagement is released.

2. An assembly as claimed in claim 1, wherein said first coupling member has two toothed racks in meshing engagement with respective of two toothed racks of said second coupling member in said coupled position.

3. An assembly as claimed in claim 2, wherein said first coupling member comprises an outer coupling member, and said second coupling member comprises an inner coupling member fitting within said outer coupling member in said coupled position.

4. An assembly as claimed in claim 3, wherein said two toothed racks of said inner coupling member are located at two opposed sides thereof and face outwardly thereof.

5. An assembly as claimed in claim 4, wherein said outer coupling member has a substantially U-shaped configuration including two spaced holding arms embracing said inner coupling member in said coupled position, said two toothed racks of said outer coupling member being located on inner sides of respective of said arms and facing inwardly thereof.

6. An assembly as claimed in claim 1, wherein said first coupling member comprises an outer coupling member, and said second coupling member comprises an inner coupling member fitting within said outer coupling member in said coupled position.

7. An assembly as claimed in claim 6, wherein said toothed rack of said inner coupling member is located at a side thereof and faces outwardly thereof.

8. An assembly as claimed in claim 7, wherein said outer coupling member has a substantially U-shaped configuration including two spaced holding arms embracing said inner coupling member in said coupled position, said toothed rack of said outer coupling member being located on an inner side of one said arm and facing inwardly thereof.

9. An assembly as claimed in claim 1, wherein said second coupling member has an elongated configuration including opposite ends, and said cable extends through said second coupling member between said opposite ends.

10. An assembly as claimed in claim 9, wherein said opposite ends of said second coupling member are tapered.

11. An assembly as claimed in claim 9, wherein said second coupling member is injection molded to said cable.

12. An assembly as claimed in claim 1, wherein said second coupling member is injection molded to said cable.

13. An assembly as claimed in claim 1, wherein one of said toothed racks has a length greater than the other of said toothed racks, such that said other toothed rack may be brought into said meshing engagement with said one toothed rack in plural positions along said length thereof.

* * * * *